United States Patent [19]

Stull

[11] Patent Number: 4,826,055

[45] Date of Patent: May 2, 1989

[54] CLOSURE CAP CONSTRUCTION

[76] Inventor: Gene Stull, 1086 Hacklebarney Rd., Chester Township, Morris County, N.J. 07930

[21] Appl. No.: 710,366

[22] Filed: Mar. 11, 1985

[51] Int. Cl.[4] ..... B67D 5/06

[52] U.S. Cl. ..... 222/524; 222/525; 222/547; 222/575

[58] Field of Search ..... 222/524, 525, 521, 520, 222/519, 522, 549, 548, 547, 544, 553, 493, 492, 575

[56] References Cited

U.S. PATENT DOCUMENTS

| | | | |
|---|---|---|---|
| 2,106,028 | 1/1938 | Heimsch et al. | 222/521 |
| 2,432,641 | 12/1947 | Wilson | 222/575 X |
| 3,194,453 | 7/1965 | Cherba | 222/521 |
| 3,276,640 | 10/1966 | Kessler | 222/525 |
| 3,599,845 | 8/1971 | Miller | 222/521 |

*Primary Examiner*—Joseph J. Rolla
*Assistant Examiner*—David H. Bollinger
*Attorney, Agent, or Firm*—H. Gibner Lehmann; K. Gibner Lehmann

[57] ABSTRACT

A compact, high-flow-rate closure cap construction for hand-held dispensers, comprising a cap body having an upstanding tubular discharge neck portion, and a closure cap having a bore receiving the neck portion. The neck portion has a cylindrical exterior sealing surface, and the bore has a sealing annulus engaged with the exterior sealing surface. The closure cap is axially slidable on the neck portion between a closed sealing position and an open, product-discharging position. The bore of the neck portion contains multiple product-flow discharge passages which enlarge the effective cross-sectional area of the bore so as to increase its flow-handling capacity, with a minimum of loss in its stiffness and rigidity. The cap has a discharge orifice that is normally closed off by a stopper peg carried by a bridge on the cap body. On the underside of the peg is a relieved area in the form of a slot, that increases the size of one of the openings constituting the discharge path, thereby facilitating an increased volume of product flow. In addition, the cap has an expansive inside wall surface along which the product flows. This surface in turn has a plurality of recesses or discharge passages, all to the end of providing decreased resistance to product flow without sacrificing wall stiffness or jeopardizing the ability to readily mold the parts out of the desired plastic substance.

17 Claims, 1 Drawing Sheet

CLOSURE CAP CONSTRUCTION

BACKGROUND

This invention relates generally to closure cap constructions, and more particularly to those of a type which are adapted to dispense viscous substances that are characterized by moderate resistance to flow, such as liquid dishwashing detergents or other household items, cosmetic creams or lotions, or for certain food substances, such as syrups, etc.

A number of known dispenser constructions employ a push-pull cap of a type wherein the cap is provided with a discharge orifice, and the cap body with an upstanding stopper plug that is adapted to be received in the discharge orifice when the cap is depressed to a closed, sealing position. In many of these structures, the physical size of the openings through the cap body and around the upstanding stopper plug is restricted to a large degree; this presents little problem where the product contained in the dispenser is of a watery consistency, since the non-viscous nature thereof permits it to flow through the relatively small passages with only minimal resistance.

With substances that are more viscous, however, flow can be severely restricted. In the past, compromises have frequently had to be made; on the one hand it was necessary to keep the physical size of the cap components small, which is important aesthetically, as well as in minimizing the amount of material employed in the molding of each part. On the other hand, consideration had to be given to providing adequate passage widths to permit the desired flow rates to be achieved, while at the same time maintaining the thicknesses of the walls of the cap components adequate to insure sufficient strength and rigidity. Moreover, the molder had to insure that in his design, the plastic substance from which the components was formed was capable of flowing into the mold cavities properly so as to completely fill all of the spaces therein and thereby avoid surface defects in the finished parts.

Attempts to make the cap walls thinner have resulted in structures which were insufficiently stiff or rigid, and which lacked the necessary strength. In addition, the problem noted above; involving proper flow of the plastic into the interstices of the mold cavity, has had to be considered.

SUMMARY

The above drawbacks and disadvantages of prior cap constructions are largely obviated by the present invention which has for one object the provision of a novel and improved closure cap construction of given size, which is both simple in its structure and reliable in use, and which enables substantially increased flow when employed with substances of a viscous nature.

A related object of the invention is to provide an improved cap construction as above set forth, wherein a minimal amount of plastic material is employed without sacrifice of adequate strength or rigidity in the finished product.

Still another object of the invention is to provide an improved cap construction as above characterized, wherein the individual parts making up the device can be economically molded in relatively simple cavities, and wherein the configuration is such that there are effectively circumvented problems involving difficulty in forcing molten plastic substance into the mold cavities in such a way as to completely fill the same.

Yet another object of the invention is to provide an improved cap construction or assembly as outlined above, wherein the assembly can be readily employed with existing containers, and wherein automatic capping equipment may be utilized in order to keep the overall manufacturing cost as low as possible.

The above objects are accomplished by a compact, high-flow-rate closure cap construction for hand-held dispensers, comprising in combination a cap body having an upstanding tubular discharge neck portion with a cylindrical exterior sealing surface, and a closure cap having a bore receiving the neck portion and having a sealing annulus engaged with the exterior sealing surface thereof. The closure cap is axially slidable on the neck portion between a closed sealing position and an open, product-discharging position. Cooperable closure means on the neck portion and closure cap are provided, for shutting off the flow of product through the neck portion. The bore of the neck portion has formed in it a plurality of product-flow discharge passages which enlarge the effective cross-sectional area of the bore so as to increase its flow-handling capacity but with a minimum of loss of the stiffness and rigidity thereof.

The objects are further accomplished by a compact, high-flow-rate closure cap construction for hand-held dispensers, comprising in combination a cap body having an upstanding tubular discharge neck portion with a cylindrical exterior sealing surface, and a closure cap having a bore receiving the neck portion and having a sealing annulus engaged with the exterior sealing surface thereof. The closure cap is axially slidable on the neck portion between a closed sealing position and an open, product-discharging position. Cooperable closure means on the neck portion and closure cap are provided, for shutting off the flow of product through the neck portion. The closure means comprises an orifice in the closure cap and a stopper peg on the neck portion. There is a bridge on the neck portion, past which product flows from the bore, the bridge supporting the sides of the stopper peg to mount it on the neck portion with the inner end of the peg exposed. The peg in its inner end has a slot providing for increased flow capacity past its inner end and past the said bridge.

The objects are still further accomplished by a compact, high-flow-rate closure cap construction for hand-held dispensers, comprising in combination a cap body having an upstanding tubular discharge neck portion with a cylindrical sealing surface, and a closure cap having a bore receiving the neck portion and having a sealing annulus engaged with the exterior sealing surface thereof. The closure cap is axially slidable on the neck portion between a closed sealing position and an open, product-discharging position. Cooperable closure means on the neck portion and closure cap are provided, for shutting off the flow of product through the neck portion. The closure means comprises an orifice in the closure cap and a stopper peg on the neck portion. The cap has an expansive inside wall surface surrounding the orifice thereof, past which the discharging product flows. The inside wall surface of the cap has a plurality of product-flow discharge passages which enlarge the effective flow area inside of the cap so as to increase the flow-handling capacity of the same with minimal loss of the stiffness and rigidity of the cap.

Other features and advantages will hereinafter appear.

In the drawings, illustrating a preferred embodiment of the invention:

Figure 1:
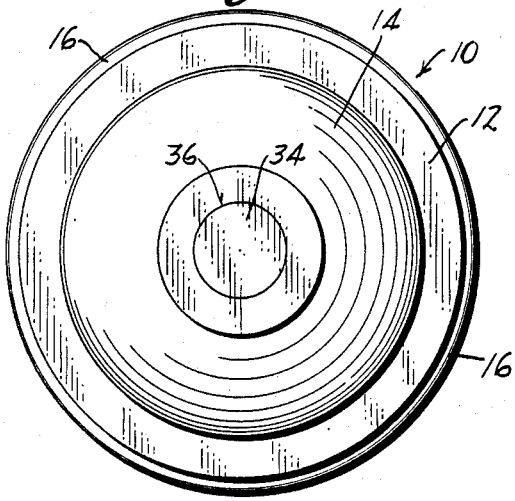
FIG. 1 is a top plan view of the improved high-flow-rate closure cap construction of the present invention.

Referring to FIGS. 1–4, there is illustrated a closure cap construction generally designated by the numeral 10, comprising a cap body 12 and a push-pull closure cap 14. The body 12 has an annular flange 16 provided with internal threads 18 that are adapted to mate with corresponding threads on the neck of a container (not shown).

Figure 2:
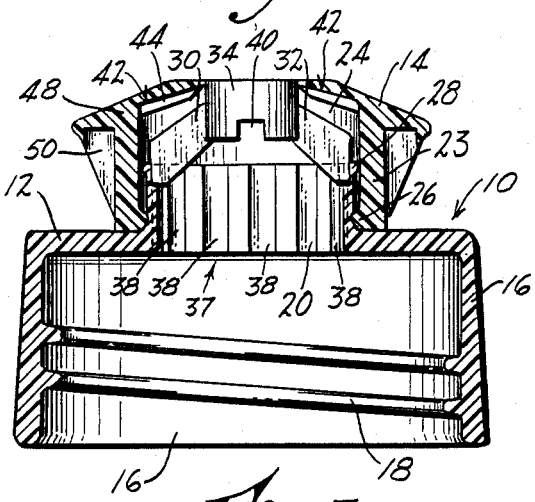
FIG. 2 is an axial section of the construction of FIG. 1, showing a cap body and a push-pull closure cap disposed in a retracted or closed, sealing position thereon.
Figure 4:
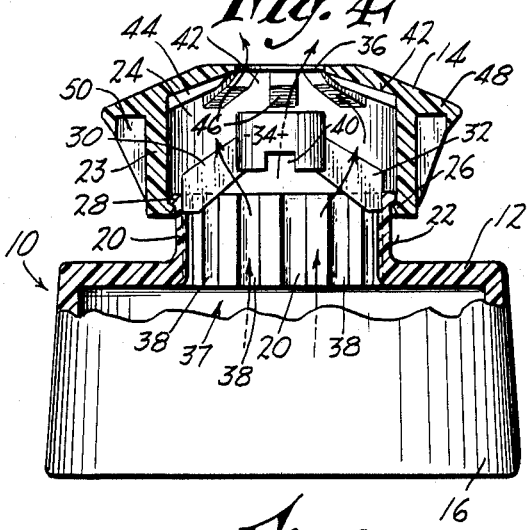
FIG. 4 is a view like that of FIG. 2, except showing the push-pull closure cap disposed in a raised, product-discharging position.

As illustrated in FIGS. 2 and 4, the cap body 12 has a neck portion in the form of an annular wall 20 with a generally cylindrical exterior sealing surface 22, and the closure cap 14 has an annular wall 23 defining a bore 24 receiving the neck portion 20. The bore has an annular sealing bead or annulus 26 that sealingly engages the cylindrical exterior surface 22, and a retainer bead 28 at the lip of the neck portion 20 also seals against the bore 24 of the closure cap 14, all in the usual manner.

The upper end of the neck portion 20 of the cap body 12 has a bridge structure comprising two angularly disposed upstanding legs 30, 32 which mount a generally cylindrical sealing plug or stopper peg 34. The latter is receivable in a discharge opening 36 in the closure cap 14 when the latter is fully seated on the cap body, as in FIG. 2. There thus exists a seal between the peg and the walls of the opening, preventing discharge of the contents of the container.

Figure 3:
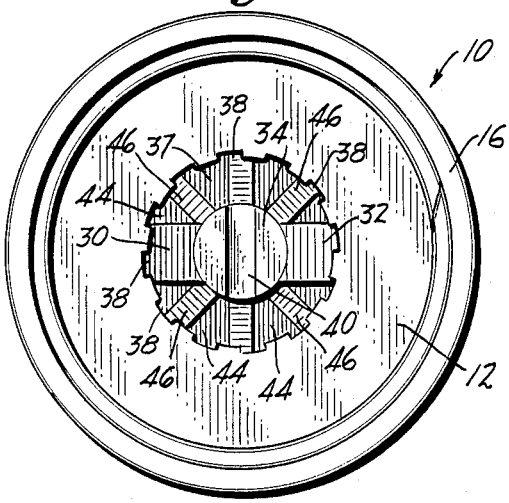
FIG. 3 is a bottom plan view of the construction of FIGS. 1 and 2.
Figure 6:
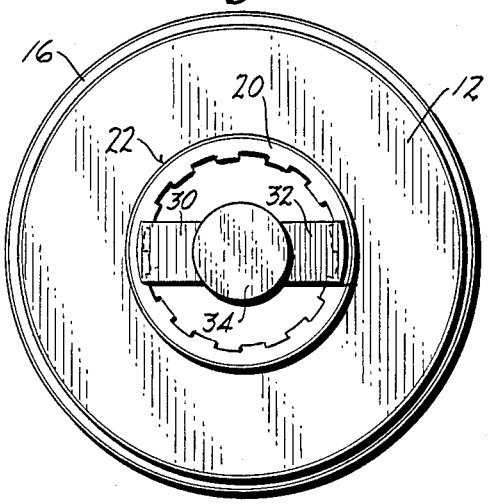
FIG. 6 is a top plan view of the cap body of the closure cap construction of FIGS. 1–5, particularly showing the stopper peg thereof.

In accordance with the present invention there is provided in the bore 37 of the neck portion 20 of the cap body 12 a plurality of product-flow discharge passages 38 which effectively enlarge the cross-sectional area of the bore 37 so as to increase the flow-handling capacity of the neck portion while at the same time not materially decreasing the strength or stiffness of the walls of the said bore. The passages 38 preferably take the form of elongate slots or grooves that are circumferentially spaced about the periphery of the bore, and which are generally parallel to the axis thereof. In the disclosed embodiment, the recesses have a width that is roughly the same as the spacing between their adjacent edges, as can be seen in FIGS. 3 and 6. The adjacent walls of the recesses are generally perpendicular, although this configuration is not essential in achieving the desired result involving reduced resistance to product flow.

Further in accordance with the invention, the underside of the stopper peg 34 has a transverse slot 40 extending from one side to the other along a diametric line of the peg, this slot being perpendicular to the plane formed by the bridge comprising the legs 30 and 32. The slot 40 is elongate, and has opposite walls that are generally parallel to one another, as shown. The inclusion of the slot in the peg does not materially affect the strength of the structure, but significantly improves the flow characteristics of the product past the area around the bridge. Ordinarily in cases where no slot is provided the cross section of the passage past the bridge is sufficiently small to cause significant restriction to flow, where viscous liquids are being dispensed.

Further in accordance with the invention, the closure cap 14 has an expansive conical inside wall surface 42 that surrounds the orifice 36 thereof, and the surface 42 has a plurality of product-flow discharge passages which enlarge the effective flow area inside of the closure cap so as to increase the flow-handling capacity of the same with minimal decrease in the stiffness and rigidity of the closure cap. These discharge passages are particularly illustrated in FIG. 5, and have a somewhat trapezoidal configuration. They are indicated by the numeral 44. The passages are in the form of recesses or grooves of tapered width, separated from one another by elongate lands 46. The depth of the passages is shown as being somewhat less than half the thickness of the cap wall. At their inner ends, the passages each communicate with the orifice 36.

Figure 5:
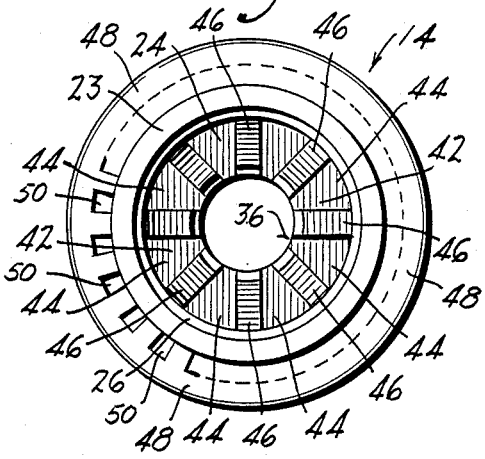
FIG. 5 is a bottom plan view of the push-pull closure cap of the construction of FIGS. 1–4, particularly illustrating the product-flow discharge passages formed therein.

Further in accordance with the invention, the closure cap 14 has a peripheral rim 48 that joins the annular wall 23, and at the juncture of the annular wall and rim there is a series of uniformly-spaced, exterior cored-out spaces 50 therein, FIGS. 2, 4, and 5, which reduce the overall amount of plastic substance required to mold the closure cap, and in addition, reduce the maximum wall thickness of the cap so as shorten overall curing time, following molding, and minimize any tendency for the cured material to contract or warp as a result of such curing. In addition, the spaces provide a decorative effect to the cap exterior, making the device more attractive from the marketing standpoint. As illustrated in FIG. 5, the cored-out spaces 50 are similar to each other. The walls forming the spaces 50 are generally perpendicular, and the width of each space is approximately the same as the distance between adjacent spaces.

FIG. 2 shows the closed, sealing position of the closure cap, whereas FIG. 4 illustrates the open or product-discharging position thereof, the product following a path along that indicated by the arrows when the cap construction is inverted. In the closed position, the outer surface of the peg is substantially flush with the wall of the closure cap surrounding the orifice 36.

The inventive structural features of the cap body and closure cap as set forth above can be readily appreciated if one considers that the present construction is especially intended for use with liquids that are of moderate to high viscosity. This would include many liquid dishwashing detergents, as well as food substances such as syrups. The device would also lend itself to use with creams or cosmetic lotions, all of which are generally of relatively thick consistency.

The objective of improving product flow could be realized in another manner by merely making the dimensions of conventional cap components large enough in order to accommodate the particular substance being dispensed. However, many times such an approach is not acceptable from a marketing standpoint, since physically large caps are often considered not aesthetically pleasing. In addition, when one considers the number of cap devices that are produced and the amount of plastic substance required per unit, making the caps physically larger would unnecessarily increase the overall cost. In addition, where thicker walls are employed, the curing time needed is increased substantially. Also, thick walls have a tendency to shrink upon curing, often giving rise to internal stresses and unsightly surface deformities or irregularities.

It should further be recognized that for a given plastic substance and mold configuration, there is a limit as to how thin a wall can be made. Thin walls must be formed by injection of molten plastic into minute spaces or interstices in the mold cavity; these minute spaces have to be completely filled in by the plastic substance while it is in a molten state. Under certain circumstances, problems are encountered in forcing the plastic into such interstices. The finished product, when stripped from the mold, often will show holes or other deformities in its surface where the substance did not flow sufficiently, such defects rendering the part unsuitable for use.

This problem involving thin walls has been largely overcome by the present invention, since the extent of the thin wall areas is small. Adjacent each thin wall segment is a considerably thicker wall area, where flow of molten plastic substance will occur substantially uninhibited. There thus occurs a spilling over of the molten material from wide areas into the narrower spaces of the mold, and the desired contours of the finished parts are thus realizeable.

In prior cap constructions of this type, considerable resistance to flow was encountered in the vicinity of the bridge, comprising the legs 30, 32. This effect was a direct result of the fact that the peg was disposed in the center of the flow path from the bore 37 of the neck portion. Furthermore, the legs constituted an additional barrier. By providing a groove or slot 40 at the underside of the peg, more space is available, since the product can take a path along that indicated by the arrows in FIG. 4. The groove does not cause any significant loss in strength of either the legs 30, 32 or the peg 34.

Similarly, resistance to flow on the underside of the cap is reduced over that which would be realized were the passages 44 to be omitted and the upper wall of the cap increased so as to have uniform thickness.

The problems noted above in connection with reduced product flow are considerably enhanced if there is a tendency for the product to dry out or solidify after a period of use, as can be readily appreciated. Any drying out or crusting of solidified product in the area around the bridge would be especially troublesome, and the improved constructions provided by the present invention would operate to reduce this deleterious effect.

Finally the disclosed device has the following two important advantages which are not enjoyed by the devices of the prior art. First, the amount of plastic material required is reduced as a result of the provision of the product-flow passages; accordingly there is a substantial cost saving realizeable. Second, the aesthetic value of the construction is not disturbed by the presence of the passages. That is, the passages 38, 40 and 44 are completely concealed from view, from outside; in fact, the consumer would not be aware of their presence, aside from the improved flow characteristics that they provide.

While the disclosed embodiment involves a cap construction of a type incorporating a push-pull type closure cap, the principles of the present invention could also be applied to twist cap constructions as well.

From the above it can be seen that I have provided a novel and improved cap construction which is simple in its structure and which provides significantly improved flow characteristics when employed with viscous substances; the parts can be readily molded in relatively simple cavities, and thereafter assembled by automatic equipment, thereby further reducing cost.

The device is thus seen to represent a distinct advance and improvement in the dispensing closure field.

Each and every one of the appended claims defines an aspect of the invention which is separate and distinct from all others, and accordingly each claim is intended to be treated in this manner when examined in the light of the prior art devices in any determination of novelty or validity.

Variations and modifications are possible without departing from the spirit of the claims.

What is claimed is:

1. A compact, high-flow-rate closure cap construction for hand-held dispensers, comprising in combination:

(a) a cap body having an upstanding tubular discharge neck portion, said cap body having means for attaching it to a container to mount the body fixedly on said container, (b) said neck portion having a discharge bore, and a sealing peg above the discharge bore, and having bridge across the bore and supporting said peg, said neck portion further having a cylindrical exterior sealing surface, (c) a closure cap having a bore receiving said neck portion, said closure cap and neck portion having cooperable sealing means, (d) said closure cap being axially slidable on the neck portion between a closed sealing position and an open, product-discharging position, and (e) cooperable closure means comprising said peg on the neck portion and walls on the closure cap, for shunting off the flow of product through the bore of said neck portion, (f) said bore of the neck portion having in it and extending between its ends, a plurality of product-flow discharge passages below said peg and bridge, which enlarge the effective cross-sectional area of the bore so as to increase the flow-handing capacity of the neck portion with a minimum of decrease in the stiffness and rigidity of the same.

2. The invention as set forth in claim 1, wherein:

(a) said discharge passages comprises a series of elongate recess in the bore, (b) said recesses being spaced circumferentially from one another and extending generally parallel to the axis of the said bore.

3. The invention as set forth in claim 2, wherein:

(a) said recesses are spaced uniformly about the bore, and have a width that is approximately the same as the spacing between them.

4. The invention as set forth in claim 2, wherein:

(a) said recesses have adjacent walls that are generally perpendicular.

5. The invention as set forth in claim 2, wherein:

(a) said recesses have a depth which is less than half the thickness of the wall defining the said bore.

6. The invention as set forth in claim 1, wherein:

(a) said discharge passages are enclosed by and completely concealed by the cap body and closure cap.

7. A compact, high-flow-rate closure cap construction for hand-held dispensers, comprising in combination:

(a) a cap body having an upstanding tubular discharge neck portion, (b) said neck portion having a cylindrical exterior sealing surface, (c) a closure cap having a bore receiving said neck portion, said closure cap and neck portion having cooperable sealing means, (d) said closure cap being axially slidable on the neck portion between a closed sealing position and an open, product-discharging position, and (e) cooperable closure means on the neck portion and closure cap, for shutting off the flow of dispensing product through said neck portion, (f) said closure means comprising an orifice in the closure cap and a stopper peg on the neck portion, (g) a bridge mounting the said stopper peg on the neck portion, past which bridge the dispensing product flows from the bore of the neck portion, said bridge comprising legs which extend obliquely from the inner end portion of the peg, to mount the latter on the neck portion with the inner end portion of the peg exposed (h) said peg in its inner end portion having a transverse slot providing for increased flow capacity for product past the inner end portion of the peg and past said bridge.

8. The invention as set forth in claim 7, wherein:

(a) the upper surface of the closure cap in the area of the orifice being substantially flush with the outer end of the peg when the closure cap is disposed in its closed sealing position.

9. The invention as set forth in claim 7, wherein:

(a) said slot is enclosed by and completely concealed by the cap body and closure cap.

10. A compact, high-flow-rate closure cap construction for hand-held dispensers, comprising in combination:

(a) a cap body having an upstanding tubular discharge neck portion, (b) said neck portion having a cylindrical exterior sealing surface, (c) a closure cap having a bore receiving said neck portion, said closure cap and neck portion having cooperable sealing means, (d) said closure cap being axially slidable on the neck portion between a closed sealing position and an open, product-discharging position, and (e) cooperable closure means on the neck portion and closure cap, for shutting off the flow of product through said neck portion, (f) said closure means comprising an orifice in the closure cap and a stopper peg on the neck portion, (g) said cap having an expansive inside wall surface surrounding the orifice thereof, past which the discharging product flows, said inside wall surface comprising an annular side wall surface and a transverse inside top wall surface, (h) said transverse inside wall surface of the cap having a plurality of product-flow discharge recesses which enlarge the effective flow area inside of the cap so as to increase the flow-handling capacity of the same with a minimum of decrease in the stiffness and rigidity of the cap.

11. The invention as set forth in claim 10, wherein:

(a) the transverse inside top wall surface of the cap is of substantially conical configuration, (b) said discharge recesses extending radially of said inside top wall surface and communicating with said orifice at their inner ends.

12. The invention as set forth in claim 10, wherein:

(a) the depth of said recesses is less than half the thickness of the wall of the closure cap.

13. The invention as set forth in claim 10, wherein:

a said closure cap is constituted of molded plastic substance, and has an annular peripheral rim, and (b) an annular wall containing said annular side wall surface and defining said bore, (c) said annular wall and peripheral rim having a series of circumferentially spaced-apart, exterior cored-out spaces therein, to reduce the amount of plastic required to mold the closure cap, and to reduce curing time thereof, following molding.

14. The invention as set forth in claim 10, wherein:

(a) said discharge recesses are enclosed by and completely concealed by the cap body and closure cap.

15. A compact, high-flow-rate closure cap construction for hand-held dispensers, comprising in combination:

(a) a cap body having an upstanding tubular discharge neck portion, (b) said neck portion having a cylindrical exterior sealing surface, (c) a closure cap having a bore receiving said neck portion, said closure cap and neck portion having cooperable sealing means, (d) said closure cap being axially slidable on the neck portion between a closed sealing position and an open, product-discharging position, and (e) cooperable closure means on the neck portion and closure cap, for shutting off the flow of product through said neck portion, (f) said closure means comprising an orifice in the closure cap and a stopper peg on the neck portion, (g) a bridge on the neck portion, past which product flows from the bore of the neck portion, said bridge being engaged with the sides of the stopper peg to mount the latter on the neck portion with the inner end of the peg exposed, (h) said peg in its inner end having a slot providing for increased flow capacity for product past the inner end of the peg and past said bridge, (i) said peg having a generally cylindrical configuration and lying along the axis of the cap body, (j) said bridge comprising two legs lying generally along an axial plane with respect to the peg, (k) said slot extending transversely of said axial plane.

16. The invention as set forth in claim 15, wherein:

(a) said slot extends substantially perpendicular to said axial plane.

17. A compact, high-flow-rate closure cap construction for hand-held dispensers, comprising in combination:

(a) a cap body having an upstanding tubular discharge neck portion, (b) said neck portion having cylindrical exterior sealing surface, (c) a closure cap having a bore receiving said neck portion, said closure cap and neck portion having cooperable sealing means, (d) said closure cap being axially slidable on the neck portion between a closed sealing position and an open, product-discharging position, and (e) cooperable closure means on the neck portion and closure cap, for shutting off the flow of product through said neck portion, (f) said closure means comprising an orifice in the closure cap and a stopper peg on the neck portion, (g) a bridge on the neck portion, past which product flows from the bore of the neck portion, said bridge being engaged with the sides of the stopper peg to mount the latter on the neck portion with the inner end of the peg exposed, (h) said peg in its inner end having a slot providing for increased flow capacity for product past the inner end of the peg and past said bridge, (i) said slot having opposite walls that are generally parallel to one another, (j) said peg having the configuration of a cylinder, (k) said slot extending from one side of said cylinder along a diametric line, to the other side of said cylinder.

* * * * *